US007679035B2

(12) United States Patent
Taylor et al.

(10) Patent No.: US 7,679,035 B2
(45) Date of Patent: Mar. 16, 2010

(54) METHOD AND APPARATUS FOR WATER-COOLING POWER MODULES IN AN INDUCTION CALENDERING CONTROL ACTUATOR SYSTEM USED ON WEB MANUFACTURING PROCESSES

(75) Inventors: Bruce Taylor, Worthington, OH (US); Rene Larive, Grand-Mere (CA)

(73) Assignee: ABB Ltd., Dublin (IE)

( * ) Notice: Subject to any disclaimer, the term of this patent is extended or adjusted under 35 U.S.C. 154(b) by 94 days.

(21) Appl. No.: 11/146,461

(22) Filed: Jun. 7, 2005

(65) Prior Publication Data

US 2005/0276016 A1 Dec. 15, 2005

Related U.S. Application Data

(60) Provisional application No. 60/578,740, filed on Jun. 10, 2004.

(51) Int. Cl.
*H05B 6/14* (2006.01)

(52) U.S. Cl. ..... 219/619; 399/328; 361/690

(58) Field of Classification Search ..... 219/619, 219/632, 216, 469, 470, 471, 601; 361/690, 361/699; 100/38, 153, 162 B, 327–329, 100/332; 399/328–330
See application file for complete search history.

(56) References Cited

U.S. PATENT DOCUMENTS

| | | | | |
|---|---|---|---|---|
| 4,675,487 | A | 6/1987 | Verkasalo | |
| 5,101,086 | A * | 3/1992 | Dion et al. | 219/632 |
| 5,329,101 | A * | 7/1994 | Ellis | 219/632 |
| 6,689,993 | B2 * | 2/2004 | Saynavajarvi | 219/619 |
| 7,022,951 | B2 | 4/2006 | Larive et al. | |
| 2003/0067749 | A1 * | 4/2003 | Tamba et al. | 361/699 |
| 2004/0022029 | A1 * | 2/2004 | Nagatomo et al. | 361/709 |

FOREIGN PATENT DOCUMENTS

| | | |
|---|---|---|
| EP | 1223246 A2 | 7/2002 |
| WO PCT/US2005/020064 | | 7/2005 |

* cited by examiner

*Primary Examiner*—Quang T Van
(74) *Attorney, Agent, or Firm*—Michael M. Rickin; Paul R. Katterle

(57) ABSTRACT

An induction heating system used on web manufacturing processes has one or more workcoils each with an associated power module. The power modules are cooled using water. In one embodiment the power modules and the workcoils are in physical contact with a full width water cooled support beam. In another embodiment the key heat generating elements of the power modules are mounted against a thermally conductive power module frame which is then mounted against the thermally conductive wall of an un-perforated water header.

20 Claims, 5 Drawing Sheets

METHOD AND APPARATUS FOR WATER-COOLING POWER MODULES IN AN INDUCTION CALENDERING CONTROL ACTUATOR SYSTEM USED ON WEB MANUFACTURING PROCESSES

CROSS REFERENCE TO RELATED APPLICATION

This application claims the priority of U.S. provisional patent application Ser. No. 60/578,740 filed on Jun. 10, 2004, entitled "Method And Apparatus For Water-Cooling Power Modules In An Induction Caliper Control Actuator System Used On Web Manufacturing Processes" the contents of which are relied upon and incorporated herein by reference in their entirety, and the benefit of priority under 35 U.S.C. 119(e) is hereby claimed.

FIELD OF THE INVENTION

This invention relates to induction heating system power modules used on web manufacturing processes and more particularly to the cooling of those modules.

DESCRIPTION OF THE PRIOR ART

A sectionalized induction calendering control actuator on a paper machine or similar web manufacturing process locally heats a calender roll to change the diameter profile of the heated calendar roll across its width. The local heating modifies the contact pressure profile between the heated calendar roll and an adjacent, contacting calender roll, thereby adjusting the thickness (caliper) profile of a web passing between them.

The induction calendering system consists of an array of inductive elements that may be referred to as workcoils that are located adjacent to the affected calender roll. When an adjustable, secondary, high-voltage (e.g. 400 volts), high frequency (e.g. 30 kHz) AC current is passed through a workcoil it induces an adjustable, localized eddy-current in the roll, to produce localized ohmic heating of the roll. This secondary, high voltage, high frequency current is first generated by an electrical element that may be referred to as a power module (one per workcoil), that converts the standard, primary supply power (e.g. 208 VAC and 60 Hz, or 220 VAC and 50 Hz) into the specialized secondary power (e.g. 400 VAC and 30 kHz).

The workcoils must be mounted on a workcoil support structure that spans the web manufacturing process and may be referred to as a workcoil beam. The power modules are typically located adjacent to the workcoils, in a one-to-one relationship, enclosed within either the workcoil beam or a separate, but usually adjacent structure, that can be referred to as a power module cabinet.

Typical commercially available workcoils and power modules transfer 4 to 6 KW to the calender roll per workcoil, with an overall actuator efficiency of 90% to 95%, thereby dissipating heat within themselves (due to ohmic losses within their circuitry) of between 200 watts and 600 watts, about half of which is typically dissipated inside the power modules (100 to 300 watts each) and half of which is typically dissipated within the workcoils (100 to 300 watts each). The workcoils, being at least partially located outside the workcoil beam, and typically containing only a magnetic material core with wire windings, are typically able to dissipate this heat to their surroundings without the need for auxiliary cooling of any sort, such as by forced convection using either air or water. Only in extreme environments, with very hot surrounding ambient air (i.e. >130° C.) and/or very hot, radiating adjacent roll surfaces (i.e. >130° C.), might the workcoils need to be cooled by a flow of water or equivalent fluid traveling through conductive tubing that surrounds the workcoil's magnetic core and conductive windings.

On the other hand, the power modules typically comprise relatively sensitive integrated circuitry, and must be enclosed within a protective structure at all times. As a result, the power modules always must be cooled by some auxiliary means to protect them from over-heating. As shown in FIGS. 1 and 2, whether the power modules 10 are enclosed in a separate power module cabinet (12 of FIG. 1) which may be on the machine as shown in FIG. 1 or off the machine as is usually required for supercalenders, or within the workcoil beam itself (40 of FIG. 2), the conventional solution is to cool them with forced air convection.

FIG. 1 shows air cooling plenum 14 with nozzles 16 and blower 18 and FIG. 2 shows an air plenum 42 with nozzles 44. FIG. 1 shows the individual workcoils 20 and FIG. 2 shows the workcoils 20 collectively. FIG. 1 shows the calender roll 22 heated by the workcoils 20 and an adjacent calender roll 24 whereas FIG. 2 shows only the calender roll 22 that is heated by workcoils 20.

Air cooling of the power modules 10 works but typically requires a volumetric airflow of 40 to 50 SCFM per power module to limit the air temperature rise to an acceptable level (45 scfm will heat up about 4° C. per 100 watts of heat absorbed). Given the foregoing, a 6-meter wide web manufacturing process with 60 mm wide zones, therefore having 100 power modules, requires a fan delivering at least 4000 SCFM, with a sizeable air distribution plenum 14 or 42 integrated into the structure that encloses the power modules 10 (whether that structure is the workcoil beam 40 or a separate power module cabinet 12). This plenum 14 or 42 then requires a cross-section large enough to ensure a low enough internal air velocity, as needed to ensure a small enough pressure drop across the plenum's length, so that the cooling air will be uniformly distributed to the array of power modules 10.

The minimum required plenum size in each application would of course depend on numerous factors, including the number of zones, the zone spacing (and hence the plenum length and the amount of heat dissipated by the power modules 10 per unit of plenum length), the amount of heat dissipated by each of the power modules 10 (which is proportional to the power module's maximum power output), and the fan's available total pressure (which must overcome various air system pressure losses, including the static pressure losses incurred across the plenum's length and across its outlet nozzles). In practice the required plenum cross-section often exceeds 1 square foot or more, and/or multiple plenum inlet connections are needed, and/or a complicated tapered plenum design is called for.

This minimum required plenum size and complexity makes it difficult to integrate the power modules into a workcoil beam such as 40 of FIG. 2 that is small enough to fit on many web calendering processes, particularly off-line supercalenders, most of which include adjacent, vertical elevators that are used to gain access to the calendar rolls for maintenance.

To meet evolving papermaking requirements the amount of power that must be transferred to the calendar rolls and therefore converted by the power modules 10, is also increasing. In the 1980's and early 1990's the maximum amount of inductive power transferred per meter of calendar roll width (often referred to as the power density, in kW/meter) was around 20 kW/meter. Today and in the future, to produce higher calender roll temperatures that promote a smoother, glossier paper surface, and to provide more responsive caliper control, implemented power densities reach and exceed 100 kW/meter. This increased power density generates higher power module heat dissipation rates per meter of plenum width, requiring ever-increasing airflows, which in turn require larger and larger plenums 14 or 42.

The resulting space limitations then mandate separate power module cabinets 12 that add significant cost to both the product and the installation effort. Separate power module cabinets 12 add material costs for the cabinet 12 and intervening high-amperage, high-voltage, heavy-gauge power cables 26 (typically referred to as Litz cables), engineering costs to design the separate cabinet 12 and its mounting on the machine, and installation labor costs to mount the separate cabinet 12 and run the intervening Litz cables 26 from it to the workcoil beam 28.

SUMMARY OF THE INVENTION

An apparatus for cooling power modules comprising:

one or more workcoils for use with a calender roll having a predetermined width;

one or more of the power modules, each for providing electrical power to an associated one of the one or more workcoils; and a support beam having the calender roll predetermined width, the support beam having a channel through which a cooling fluid can flow, each of the one or more workcoils mounted on that side of the support beam channel that would be mounted adjacent the calender roll and each of the associated power modules mounted on the side of the support beam channel opposite to the side on which the one or more workcoils is mounted.

An apparatus for cooling power modules comprising:

one or more workcoils for use with a calender roll having a predetermined width;

one or more of the power modules, each for providing electrical power to an associated one of the one or more workcoils; and a support beam having the calender roll predetermined width, each of the one or more power modules mounted internal to the support beam in a manner such that key heat generating elements of each the power module are against a channel in the support beam through which a cooling fluid can flow.

An apparatus for cooling modules that provide electrical power to an associated one of one or more workcoils for use with a calender roll having a predetermined width comprising:

one or more of the power modules; and a support beam having the calender roll predetermined width, each of the one or more power modules mounted internal to the support beam in a manner such that key heat generating elements of each the power module are against a channel in the support beam through which a cooling fluid can flow.

A web making machine comprising:

at least one calender roll;

a beam to support one or more workcoils;

one or more power modules each associated with one of the workcoils; and a channel in the beam through which a cooling fluid can flow, the one or more power modules mounted against the channel.

DESCRIPTION OF THE PREFERRED EMBODIMENT(S)

Figure 1:
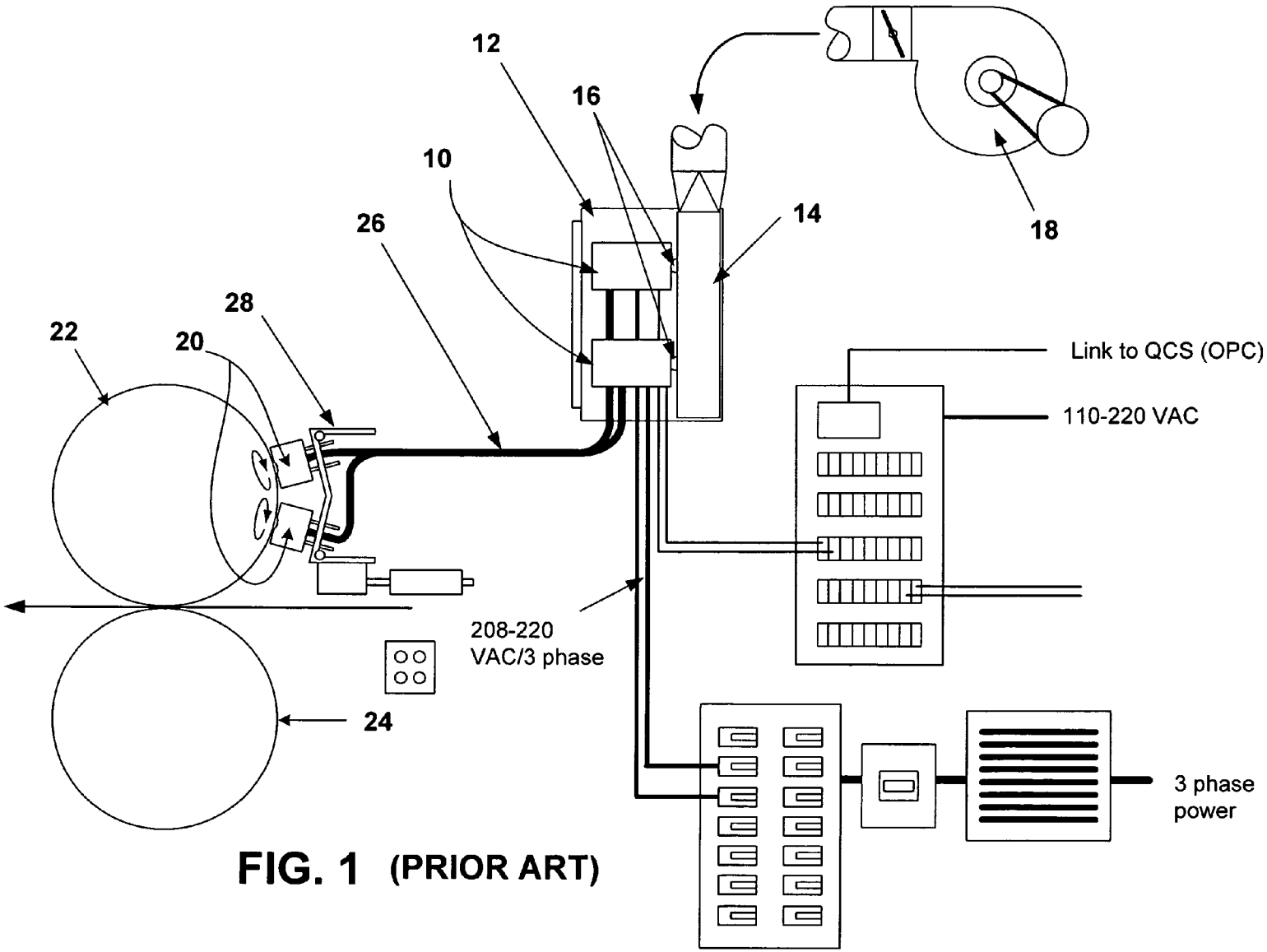
FIG. 1 (PRIOR ART)
FIG. 1 shows in accordance with the prior art air-cooled power modules mounted in a separate cabinet.
Figure 2:
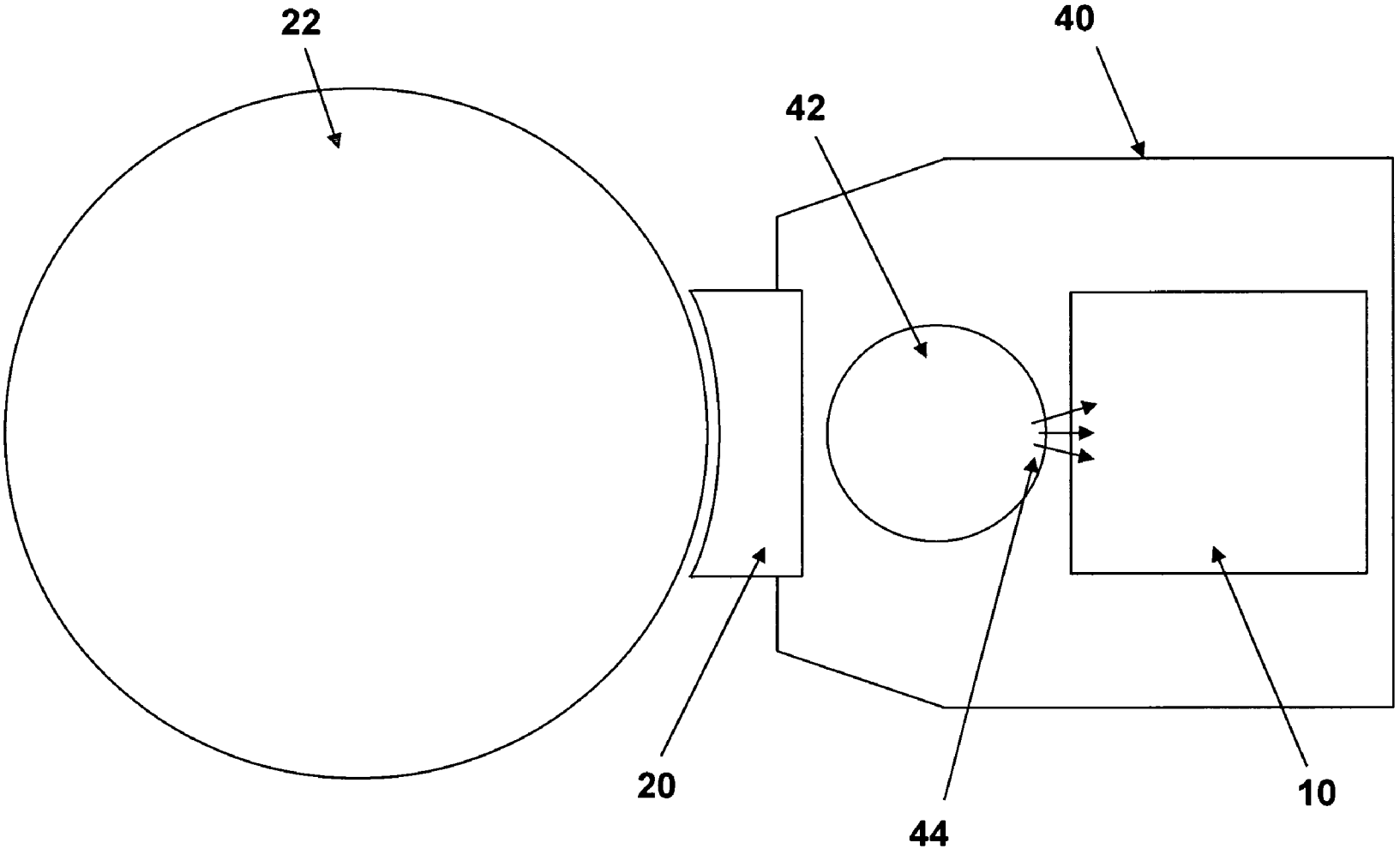
FIG. 2 (Prior Art)
FIG. 2 shows in accordance with the prior art air-cooled power modules mounted within the workcoil beam.

To solve the problems described above that are inherent in an air-cooled configuration, the modules 10 must be cooled in a more efficient manner that requires less space, hardware cost and labor cost than the prior art forced air convection cooling shown in FIGS. 1 and 2. A preferable approach would be to cool the power modules indirectly using water, which is commonly available and has a much higher heat capacity and mass density than air. However, it is not practical to cool the power modules 10 with a conventional water-cooling architecture as the conventional architecture:

a. first distributes the cooling water across the machine's width through a common feed manifold;

b. then distributes the cooling water through individual feed lines to water-cooled heat-sinks integrated into the power modules 10; and c. then after passage through this array of heat sinks, collects the heated water with individual return lines and routes it back into a common, machine-wide, return manifold for routing back to a common, off-machine cooling system, such as an air-cooled evaporative chiller, or a shell-and-tube heat exchanger cooled by a separate, parallel, cooling water supply.

The fundamental problem with this conventional, closed-loop cooling water architecture is that the individual feed and return lines, to and from the power modules 10, require individual connections to both the power module heat sinks and the feed and return manifolds, all of which can leak. Any water leakage in the presence of the power module's high voltages (typically 208 to 400 VAC) is very unsafe and totally unacceptable.

An electrically non-conductive heat transfer fluid such as mineral oil, or a refrigerant that would instantly convert to a non-conductive gaseous state at atmospheric pressure, might be used in lieu of water, but there are drawbacks with such alternative fluids. These exotic fluids are not always native to a paper mill, they're more expensive than water, their densities and heat capacities aren't as high as those of water, they pose a house-keeping burden in the event of leaks, and from a marketing perspective they might not entirely overcome the perceived electrical safety risks associated with leaks.

Figure 3:
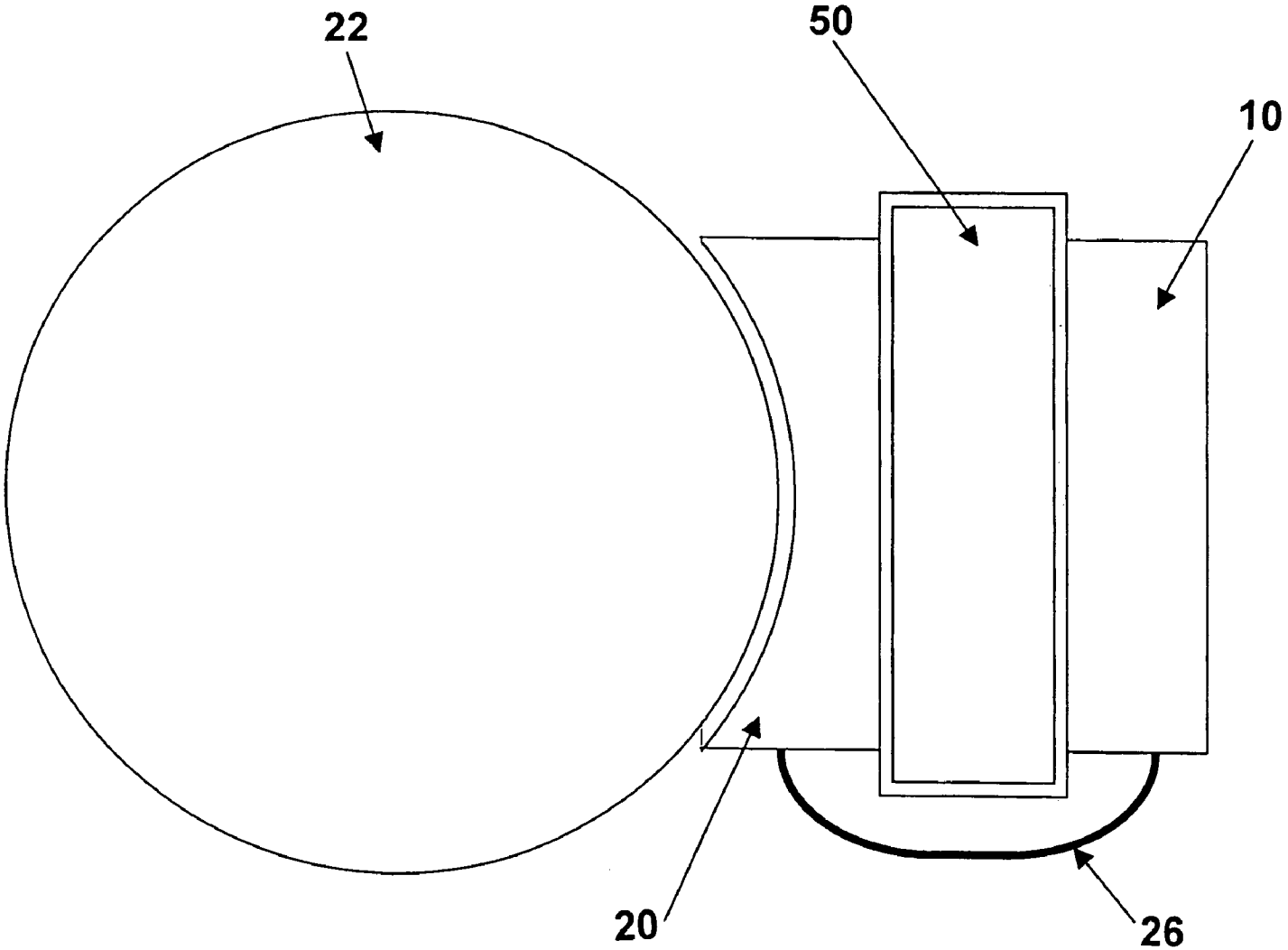
FIG. 3 shows the one embodiment for the present invention in which both the power modules and workcoils are cooled by contact with a water-containing support beam.

Referring now to FIG. 3, there is shown a first embodiment of the present invention wherein both the power modules 10 and workcoils 20 are in physical contact with a full-width, water-cooled, support beam 50. This first embodiment addresses the primary requirements of thermal contact of the power modules 10 with a non-perforated, full-width, water-cooled heat-sink 50. If it is not possible in this embodiment of the present invention to conduct all of the heat dissipated by the power modules 10 into the water-containing beam or header 50, then any remaining heat dissipated by the power modules could be absorbed by a small flow of purge air that requires the addition of a pressurized enclosure not shown in FIG. 3, which would surround the water-cooled beam 50.

As explained above, workcoils 20 do not always need to be cooled by active means. When, however, the workcoils 20 do need to be cooled by active means the cooling fluid (i.e. water) needs to be transported in close vicinity to the workcoil's metallic core and conductive windings, by means of channels or tubes formed within the workcoil's casing, rather than just by peripheral contact of one side of the workcoil against an adjacent, water-cooled beam or header 50, as is depicted in FIG. 3.

Figure 4:
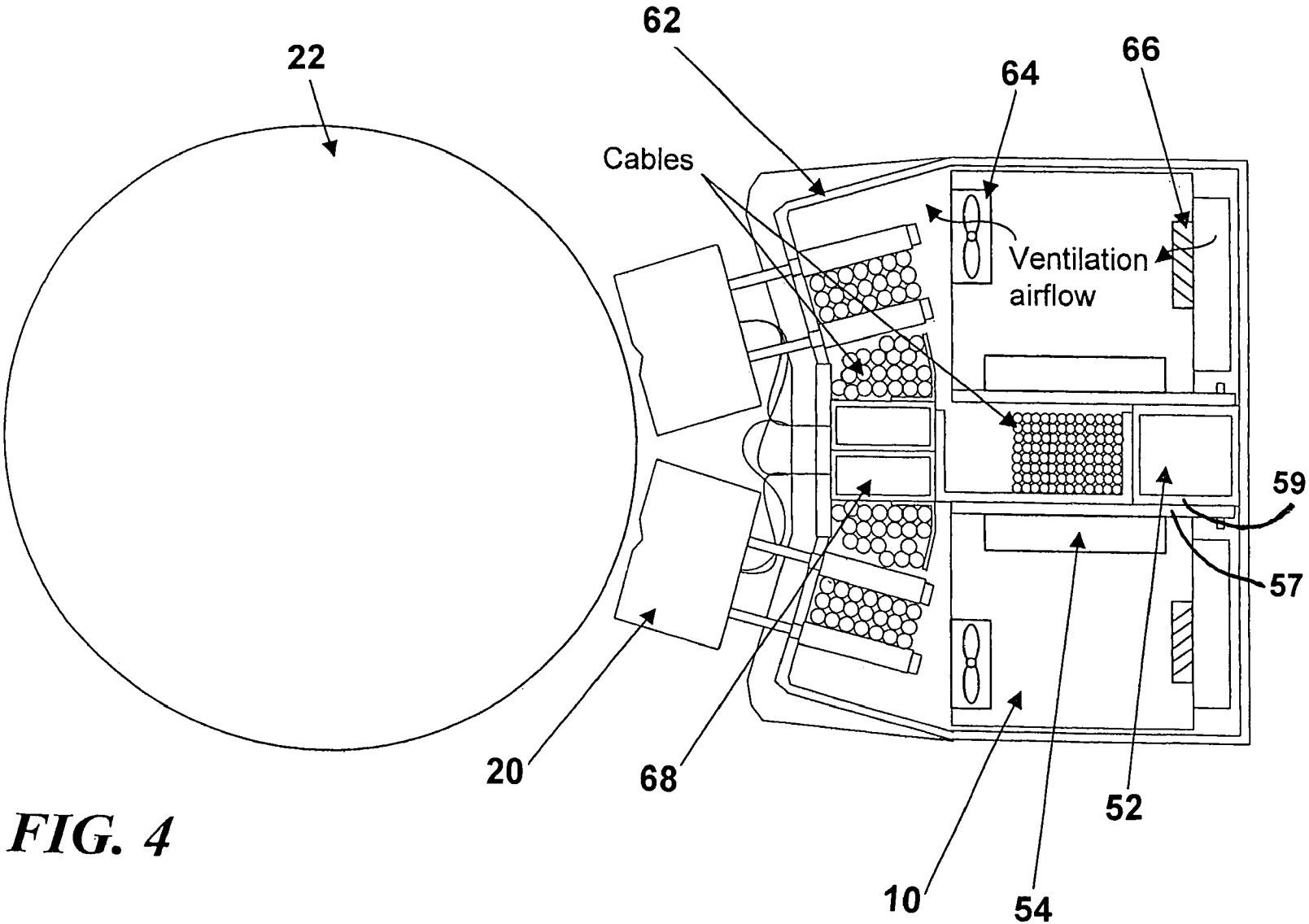
FIG. 4 shows another embodiment for the present invention in which the power modules are primarily cooled by water, and partially cooled by air.

Referring now to FIG. 4, there is shown another embodiment for the present invention. The embodiment shown in FIG. 4 eliminates the unacceptable leakage risk of the conventional water-cooling architecture described above and makes use of plentiful water, by mounting the power modules 10 flat against an un-perforated water header 52 and conducting the heat dissipated by the modules 10 into the header 52 by means of contact conduction, while permitting, if necessary, the flow of a small purge air volume around the power modules 10 to absorb any of the dissipated heat that cannot be absorbed by the header 52.

As illustrated in FIG. 4, this heat conduction is facilitated by mounting the key heat-generating elements 54 (such as chokes, IGBTs and capacitors) of each power module 10 against a thermally-conductive power module frame 57 (which may be constructed of aluminum or any other thermally-conductive material). The power module's thermally conductive frame 57 is then fastened tightly against the thermally-conductive wall 59 of one or more, machine-wide water headers 52 (which may also be constructed of aluminum). An intervening, thermally-conductive gasket or paste may be used when the thermally conductive power module frame 57 is fastened to the water headers 52.

In the embodiment shown in FIG. 4, the heat generated by the power module's components 54 is thus conducted through the power module's frame into the water header's wall, and then into the water itself. The resulting, heated, common water flow is then conveyed from the outlet 56 of FIG. 5 of the water header 52 to an off-machine cooling device 60 of FIG. 5 (such as an air-cooled or water-cooled evaporative chiller, or a shell-and-tube heat exchanger cooled by a separate, parallel, cooling water supply), and then routed back around again into the inlet 58 of FIG. 5 of the water header 52 to repeat the process.

The water header's single inlet and outlet connections can be located outside the end-plates of the workcoil beam 62 to completely eliminate any risk of leakage inside the enclosed space of the workcoil beam. In addition to eliminating the risk of leakage, the present invention requires only a single, unidirectional water header 52, rather than separate feed and return headers, as would be needed with a conventional water-cooling architecture.

If it is not possible in this embodiment of the present invention to transfer all of the heat dissipated by the power modules 10 to the water header 52, then the remaining heat could be absorbed by a small cooling airflow that can conveniently also be used to pressurize the enclosure to prevent the ingress of liquid and solid contaminants. For example, if about 80% of the heat dissipated by modules 10 is transferred to header 52 then for a power module 10 that is outputting 6 kW, and in turn is dissipating at 4% losses up to about 250 watts of heat, about 200 watts is dissipated to the water header 52 and 50 watts to the purge air. This requires a purge-air flow rate of only about 10 scfm/zone (instead of the 40-50 scfm/zone needed with conventional systems) to ensure a purge-air temperature rise of about 1.5° C. per 1 kW/zone of output power. This airflow is small enough to eliminate the need for a separate air plenum, allowing the purge air to be blown across the machine in the space between the power modules and the inside of the beam.

Figure 5:
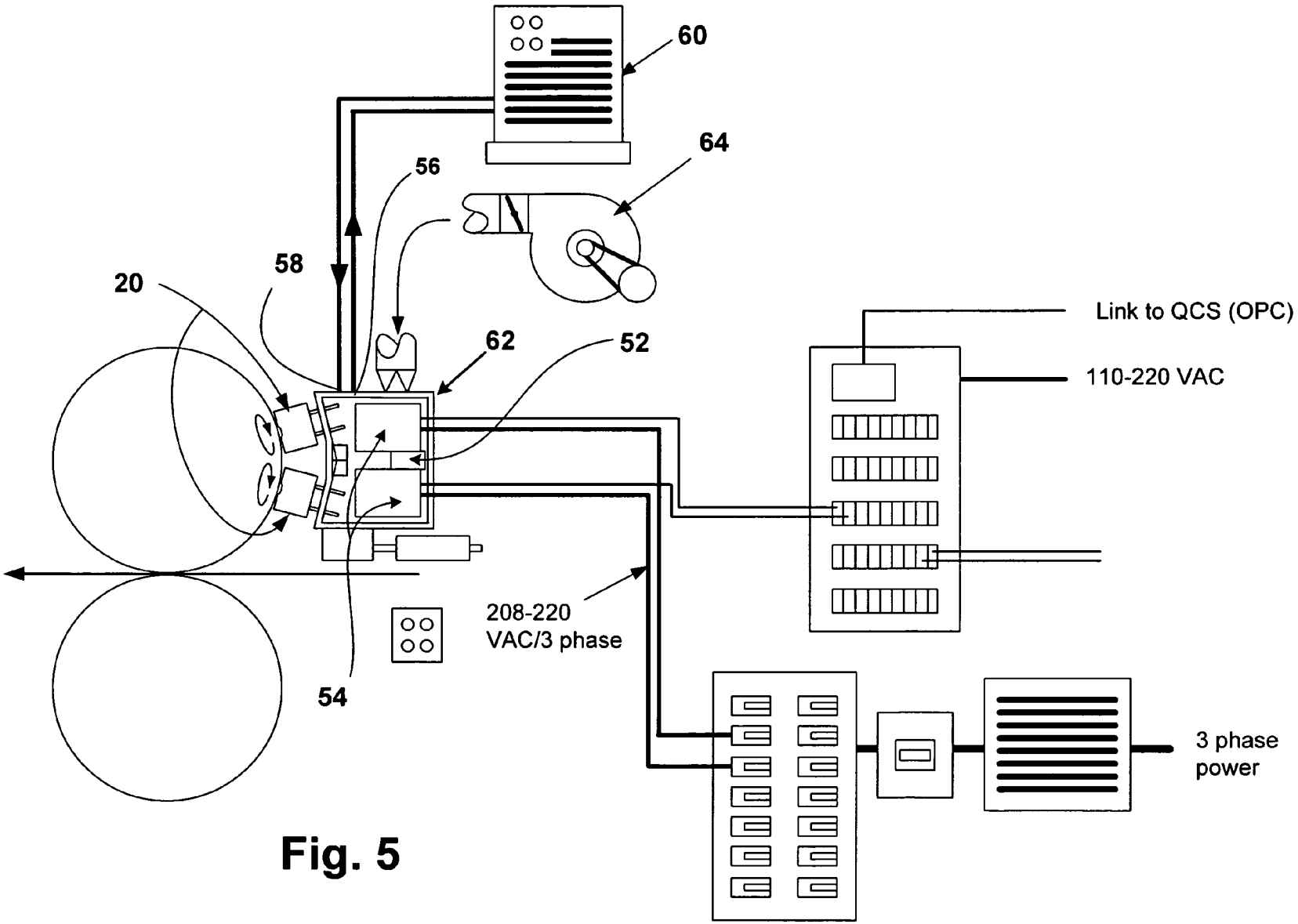
FIG. 5 shows the water-cooled power modules, in accordance with the present invention, on a web-manufacturing machine.

In addition to the small cooling air flow if needed and to prevent localized hot spots and over-temperature conditions the power modules 10 can be individually encased and include an integrated small "pancake-style" blower 64 (typically with a capacity of 10-20 scfm) as illustrated in FIGS. 4 and 5. The pancake-blower 64 draws ventilation air in through an intake grill 66, then across the power module's internal components, and then dumps the absorbed heat out of the power module 10 where it can be easily picked up by the surrounding purge-air flow that flows from one end of the workcoil beam to the other before exhausting to the exterior.

The embodiment shown in FIG. 4 can also include optional, separate, water supply and return headers 68 to convey cooling water to and from optional water-cooled workcoils 20. These optional workcoil cooling headers 68 are welded into the structure, or mounted to its exterior, in a manner that prevents leakage of water to the interior common space surrounding the power modules.

As illustrated in FIG. 5, the present invention:

a. eliminates the need for an integrated, parallel air plenum;

b. encloses the power modules 10 in a single, more compact, less costly beam cross-section to which the workcoils 20 are also mounted; and c. requires, as compared to the solutions of the prior art, a simpler, less costly external scope of supply (material and labor cost savings associated with the elimination of the large power module cabinet cooling blower and its associated ducting).

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A heating apparatus for connection to a power source and operable to heat a calender roll having a predetermined width, the heating apparatus comprising:

one or more workcoils operable to inductively heat the calender roll;

one or more power modules operable to convert primary power from the power source to a higher frequency secondary power, each of the one or more power modules providing secondary power to an associated one of said one or more workcoils; and a support beam having said calender roll predetermined width, each of said one or more power modules mounted internal to said support beam in a manner such that each said power module is disposed in contact against a channel in said support beam through which a cooling liquid can flow, the channel having no openings inside the support beam and being in thermal contact with each said power module.

2. The apparatus of claim 1 wherein each of said one or more workcoils are mounted on that part of the exterior of said beam that would be mounted adjacent the calender roll.

3. The apparatus of claim 1 wherein said one or more workcoils are also cooled by a cooling liquid.

4. The apparatus of claim 1 wherein said support beam further comprises one or more channels separate and distinct from said channel against which said power modules are mounted for cooling said one or more workcoils by flow of liquid through said separate and distinct channels.

5. The apparatus of claim 1 wherein said liquid flows through said support beam in only one direction.

6. The apparatus of claim 1 wherein each of said one or more power modules has key heat generating elements mounted against a thermally conductive frame and wherein said frame is fastened against a thermally conductive wall of said channel.

7. The heating apparatus of claim 1, wherein the one or more power modules comprises first and second power modules and wherein the channel carrying the cooling liquid is disposed between the first and second power modules.

8. The heating apparatus of claim 7, wherein the cooling liquid comprises water and wherein the heating apparatus further comprises a cooling device that is located outside the support beam and is connected to the channel, the cooling device being operable to receive water from the channel that has been heated by the one or more power modules, cool the received water and return the cooled water to the channel.

9. The heating apparatus of claim 1, wherein each of the one or more power modules comprises a blower.

10. A web making machine comprising:

at least one calender roll;

one or more workcoils operable to inductively heat the calender roll;

a beam to support said one or more workcoils;

one or more power modules each associated with one of the workcoils, the one or more power modules being operable to convert primary power from a power source to a higher frequency secondary power; and a channel in the beam through which a cooling liquid can flow, said one or more power modules mounted in contact against said channel so as to be in thermal contact therewith, the channel having no openings inside the beam.

11. The web making machine of claim 10 wherein said one or more power modules each have key heat generating elements and said key heat generating elements are mounted against said support channel.

12. The web making machine of claim 10 wherein said support beam further comprises one or more channels separate and distinct from said channel against which said power modules are mounted for cooling said one or more workcoils by flow of liquid through said separate and distinct channels.

13. The web making machine of claim 10 wherein said liquid flows through said channel in only one direction.

14. The web making machine of claim 10 wherein said one or power modules each have key heat generating elements and said key heat generating elements are mounted against a thermally conductive frame and said frame is fastened against a thermally conductive wall of said channel.

15. The web making machine of claim 10, further comprising a cooling device connected to the channel, the cooling device being operable to receive cooling liquid from the channel that has been heated by the one or more power modules, cool the received cooling liquid and return the cooled cooling liquid to the channel.

16. A heating apparatus for connection to a power source and operable to heat a calender roll, the heating apparatus comprising:

a header through which cooling liquid may flow, the header extending the width of the calender roll;

a workcoil operable to inductively heat the calender roll;

a power module in physical and thermal contact with the header and operable to convert primary power from the power source to a higher frequency secondary power, the power module providing secondary power to the workcoil;

flow connectors;

a cooling device connected to the header by the flow connectors, the cooling device being operable to receive cooling liquid from the header that has been heated by the power module, cool the received cooling liquid and return the cooled cooling liquid to the header; and wherein the flow connectors are the only connections that permit cooling liquid to flow into or out of the header.

17. The heating apparatus of claim 16, further comprising a support beam that encloses both the power module and the header.

18. The heating apparatus of claim 16, wherein the workcoil is mounted on a first side of the header and the power module is mounted on an opposing second side of the header.

19. The heating apparatus of claim 16, wherein the header is a first header and wherein the heating apparatus further comprises second and third headers for conveying cooling liquid to and from, respectively, the workcoil.

20. The heating apparatus of claim 16, wherein the power module is a first power module, the heating apparatus further comprises a second power module, and wherein the header carrying the cooling liquid is disposed between the first and second power modules.

* * * * *